United States Patent [19]

Bergquist

[11] 4,447,992

[45] May 15, 1984

[54] SHUTTLE FOR A TUMBLING OPERATION

[75] Inventor: Everett J. Bergquist, Glastonbury, Conn.

[73] Assignee: United Technologies Corporation, Hartford, Conn.

[21] Appl. No.: 303,678

[22] Filed: Sep. 18, 1981

[51] Int. Cl.[3] ..... B24B 31/00

[52] U.S. Cl. ..... 51/163.1; 51/217 R; 51/310; 51/313

[58] Field of Search ..... 51/163.1, 164.5, 216 R, 51/217 R, 410, 422, 310, 313, 421, DIG. 15

[56] References Cited

U.S. PATENT DOCUMENTS

| | | | |
|---|---|---|---|
| 2,565,925 | 8/1951 | Lombard | 51/217 R |
| 2,612,082 | 9/1952 | Angell et al. | 51/277 X |
| 3,818,646 | 6/1974 | Peterson | 51/217 R |
| 4,033,569 | 7/1977 | Dunn | 51/217 R |

FOREIGN PATENT DOCUMENTS

| | | | |
|---|---|---|---|
| 628282 | 10/1961 | Canada | 51/217 R |

*Primary Examiner*—Don Schran
*Assistant Examiner*—Douglas D. Watts
*Attorney, Agent, or Firm*—Charles A. Warren

[57] ABSTRACT

A device for shielding a particular area of an irregularly shaped article during a tumbling operation, thereby to protect this area from the action of the tumbling medium.

6 Claims, 3 Drawing Figures

SHUTTLE FOR A TUMBLING OPERATION

DESCRIPTION

1. Technical Field

A shuttle is constructed to support an irregularly shaped object such as a compressor blade or vane during a tumbling operation with a masking device protecting a selected area of the object from a tumbling action without direct contact with the object.

2. Background Art

Many mechanical parts for example compressor blades and vanes for gas turbines are given a desirable surface finish by a tumbling action in which the parts are placed in a tumbling barrel with a tumbling media which may or may not be abrasive and the barrel is then rotated to obtain the desired action from the pieces being tumbled. Different barrel configurations and different tumbling media control the aggressiveness of the tumbling action in order to produce the desired surface edge geometry.

It is well known that tumbling operations are most effective on corners and edges of the part being treated and when the part is irregular in shape, one part may be more vigorously acted upon by the tumbling medium. This is particularly true with compressor blades or vanes where the leading edge and trailing edge may be dissimilar. For best results two tumbling operations are desirable, one to produce the desired surface finish at and adjacent the trailing edge and another to produce the desired surface finish at and adjacent the leading edge. These separate tumbling operations use either different timings or different media for the desired result. When treating one edge of a part such as a compressor blade, the other edge must be protected from the tumbling action. Masking one edge has been attempted but it has been generally unsatisfactory because the tumbling action is effective in removing the masking material thus exposing the masked edge. If the masking material stays in place there is a sharp line of demarcation at the edge of the masked area and this is generally undesirable.

DISCLOSURE OF THE INVENTION

A feature of the invention is a shuttle arrangement for the parts to be treated with protection for a selected area that is not in contact with the area. Another feature is a protective or masking device that will not leave a line of demarcation on the finished part. Another feature is a protective device that may be used repeatedly on successive parts with full effectiveness.

According to the invention the part to be tumbled which may be a compressor blade or vane for example is mounted in a shuttle that engages the root or end shroud on the blade or vane and has a projecting spar thereon that extends in parallel relation to the edge of the part to be protected but out of contact therewith so as to leave no demarcation line on the part. The clearance between the spar and the edge of the part is such that the tumbling media does not pass readily between the spar and the part and thus causes no significant action on this area of the part. In this way the shuttle and spar may be used repeatedly on successive parts with complete effectiveness.

BEST MODE FOR CARRYING OUT THE INVENTION

Figure 1:
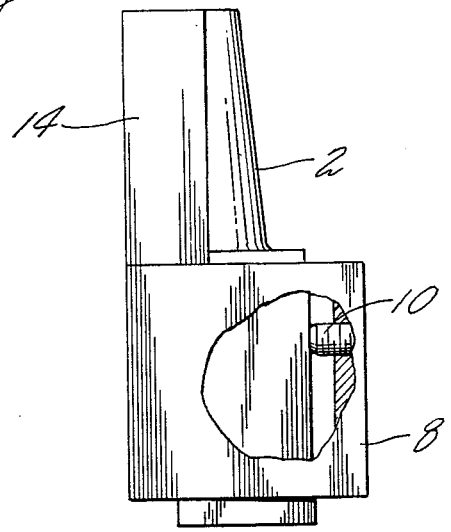
FIG. 1 is an elevation of a shuttle incorporating the invention.
Figure 3:
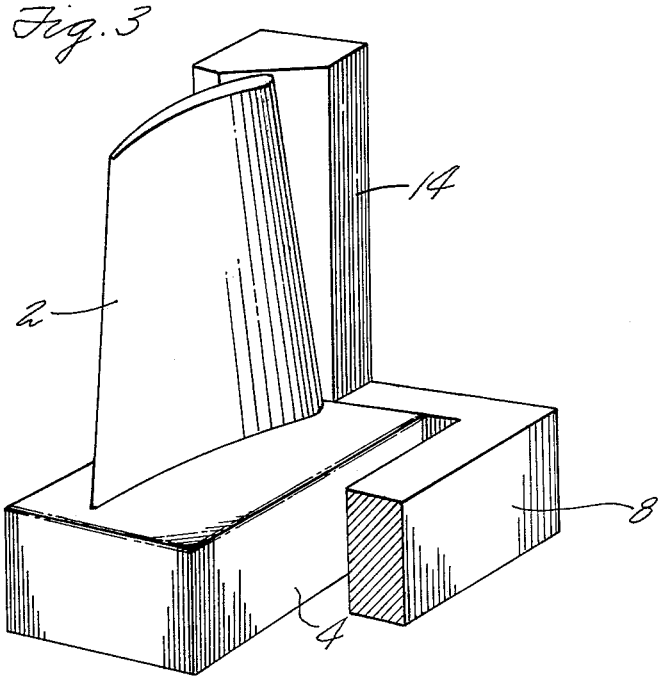
FIG. 3 is a perspective view of the device.

Referring to FIG. 1 the compressor blade 2 to be treated has a root 4 thereon that is positioned in a shuttle 6. This shuttle has a hollow rectangular base 8 to receive the blade root and the root is held securely in one corner of the hollow part of the shuttle base as by set screws 10 and 12 in adjacent sides of the base. These set screws when tightened have their slot receiving outer ends flush with or below the shuttle surface to prevent tumbling action on these screws that would affect the ability to remove the screws.

Projecting upwardly from the base of the shuttle is a spar 14 which may be generally of triangular cross section and positioned so as to extend in parallel spaced relation to the edge of the airfoil portion of the blade, that is to say that portion of the blade that is to be protected against the tumbling action. The spacing is relatively close and gaps up to 1/100 of an inch have been used effectively. The spar extends the length of the airfoil portion as will be apparent.

Figure 2:
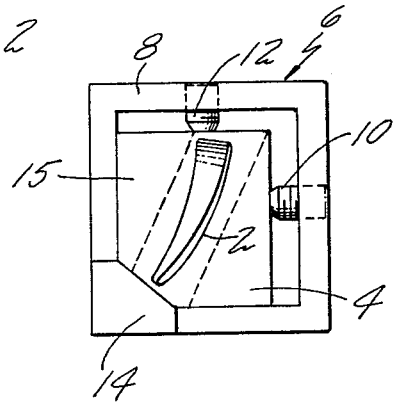
FIG. 2 is a plan view of the device.

It is not usual to have a rectangular base on the blade or vane and to make the blade or vane fit within the shuttle with the edge of the vane in proper relation to the spar the root of the blade 4 represented by the dotted lines in FIG. 2 may thus have a false root 15 cast around the blade root to provide the desired shape to fit with and be clamped in the base of the shuttle. The same would be accomplished with a vane which instead of a root may have a shroud at either end around one of which a false shroud or root portion could be cast.

In a tumbling action on several blade shapes it is desirable to give a different tumbling action on the trailing edge than on the leading edge. In this event one shuttle would be used as shown in which the leading edge is positioned in closely spaced relation to the spar for one tumbling action. The blade would then be remounted in the same shuttle or in a similar shuttle with the trailing edge closely spaced from the spar for second tumbling action on the leading edge. With differently shaped leading and trailing edges it is frequently desirable to use a different cycle and/or a different tumbling medium on the two edges and this arrangement makes possible the different tumbling operations.

Although the surface of the spar adjacent to the blade edge is shown as flat and having a significant width close to the edge of the blade, this flat surface is not critical so long as the shape is such as to prevent action of the tumbling medium on the protected edge of the blade.

In operation, the properly shaped shuttle has the part mounted therein. As shown the part is a compressor blade which is clamped in position in the shuttle base and with the appropriate edge of the blade in closely spaced relation to the spar. That is to say, the edge of the blade to be protected from the tumbling operation is positioned close to the spar. The shuttle and the part are then placed as a unit in the tumbling barrel with the appropriate tumbling medium and tumbled in the appropriate tumbling cycle. Because of the spar the tumbling medium performs the desired operation on the unprotected edge of the blade but is ineffective on the protected edge adjacent to the spar because the medium is prevented from operative contact with this edge.

After one edge of the blade is suitably treated the blade is removed from the shuttle and replaced in the same or a different shuttle with the treated edge close to the spar and the untreated edge unprotected so that it may have the appropriate tumbling operation performed thereon. This is particularly desirable where the two blade or vane edges are of a different shape and require somewhat different tumbling treatments either by the use of different tumbling materials, either grain size or consistency for example, or a longer or shorter or slower tumbling action.

A particular advantage is that there is no need for masking operation of any type with the attendant problems and no direct contact between any portion of the blade being tumbled and the protecting spar so that no line of demarcation will appear on the article after the tumbling operation is completed.

Although the invention has been shown and described with respect to a preferred embodiment thereof, it should be understood by those skilled in the art that other various changes and omissions in the form and detail thereof may be made therein without departing from the spirit and scope of the invention.

I claim:

1. A support for an article such as a compressor blade or vane for a tumbling operation, said blade or vane having a root portion and an airfoil section with leading and trailing edges, such support having:

a base with a recess to receive the root portion of the blade or vane;

clamping means in said base to engage said root portion and hold it in position with the airfoil section projecting therefrom and;

a spar extending from said base and in closely spaced parallel relation to and out of contact with one of said edges, said spar being located only at the end of the airfoil section at said one of said edges and being otherwise completely out of contact with and at a greater spacing from the remainder of the airfoil to form a shield for said edge and to protect said one of said edges from the action of the tumbling material.

2. A support as in claim 1 in which the spar has a substantially flat surface extending parallel to and spaced from said one of said edges.

3. A support as in claim 1 in which the spar is of a length substantially equal to the length of the edge of the article adjacent thereto.

4. A support as in claim 1 in which the recess in said base is positioned with respect to the spar to position an article therein with one of the edges thereof in the desired closely spaced parallel relation to the spar.

5. In a tumbling operation for treating one of the leading or trailing edges of an article having an airfoil section and a root at one end, the steps of:

providing a support for the article having a base with a recess therein to receive said root and a spar extending from said base;

clamping said article in said support with the root positioned in and held in said recess and with the edge of the airfoil section not to be treated, positioned in closely spaced parallel relation to the spar, the latter being closely spaced from and out of contact with and shielding said edge and with the edge to be treated located remote from said spar; and positioning the support with the article therein in a tumbling device for a tumbling operation.

6. In a tumbling operation as in claim 5 the additional step of reversing the position of the article in the support to position the treated edge in closely spaced relation to the spar and performing another tumbling operation to treat the other edge.

* * * * *